US008611800B2

(12) United States Patent
Kawamata

(10) Patent No.: US 8,611,800 B2
(45) Date of Patent: Dec. 17, 2013

(54) IMAGE FORMING APPARATUS AND IMAGE FORMING METHOD

(75) Inventor: Shinichi Kawamata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 189 days.

(21) Appl. No.: 13/198,399

(22) Filed: Aug. 4, 2011

(65) Prior Publication Data

US 2012/0213546 A1 Aug. 23, 2012

(30) Foreign Application Priority Data

Feb. 17, 2011 (JP) ..... 2011-032530

(51) Int. Cl.
*G03G 15/20* (2006.01)

(52) U.S. Cl.
USPC ..... 399/326; 399/346

(58) Field of Classification Search
USPC ..... 399/34, 71, 123, 326, 343, 346, 350
See application file for complete search history.

(56) References Cited

U.S. PATENT DOCUMENTS

2004/0136763 A1* 7/2004 Murakami et al. ..... 399/350
2007/0183824 A1* 8/2007 Suda et al. ..... 399/346

FOREIGN PATENT DOCUMENTS

JP 2000227697 A * 8/2000
JP 2009134152 A * 6/2009
JP 2010186093 A * 8/2010

* cited by examiner

*Primary Examiner* — Clayton E Laballe
*Assistant Examiner* — Victor Verbitsky
(74) *Attorney, Agent, or Firm* — Sughrue Mion, PLLC

(57) ABSTRACT

An image forming apparatus includes an image carrier; a charging unit; an electrostatic latent image forming unit; a development unit that houses an electrostatic latent image developer containing toner particles and inorganic particles added thereto and that develops the electrostatic latent image to form a toner image; an intermediate transfer body to which the toner image is transferred and the surface of which contains a resin material and fluorocarbon resin particles; a first transfer unit that first transfers the toner image to the surface of the intermediate transfer body; a second transfer unit that second transfers the transferred toner image to a recording medium; and a cleaning unit that cleans the surface of the intermediate transfer body after the toner image is second transferred to the recording medium, the cleaning unit including a cleaning blade provided in contact with the surface of the intermediate transfer body.

14 Claims, 4 Drawing Sheets

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2011-032530 filed Feb. 17, 2011.

BACKGROUND (i) Technical Field

The present invention relates to an image forming apparatus and an image forming method.

(ii) Related Art

An electrophotographic process is widely used for copying machines, printers, and the like.

SUMMARY

According to an aspect of the invention, there is provided an image forming apparatus including an image carrier, a charging unit that charges the surface of the image carrier, an electrostatic latent image forming unit that forms an electrostatic latent image by exposure of the charged surface of the image carrier, a development unit that houses an electrostatic latent image developer containing a toner containing toner particles and inorganic particles externally added thereto and that develops the electrostatic latent image formed on the image carrier with the electrostatic latent image developer to form a toner image, an intermediate transfer body to which the toner image formed on the surface of the image carrier is transferred and the surface of which contains a resin material and fluororesin particles, a first transfer unit that first transfers the toner image formed on the surface of the image carrier to the surface of the intermediate transfer body, and a second transfer unit that second transfers the toner image transferred to the surface of the intermediate transfer body to a recording medium, and a cleaning unit that cleans the surface of the intermediate transfer body after the toner image transferred to the surface of the intermediate transfer body is second transferred to the recording medium, the cleaning unit including a cleaning blade provided in contact with the surface of the intermediate transfer body.

BRIEF DESCRIPTION OF THE DRAWINGS

Exemplary embodiments of the present invention will be described in detail based on the following figures, wherein.

DETAILED DESCRIPTION

An exemplary embodiment of the present invention is described below.

Figure 1:
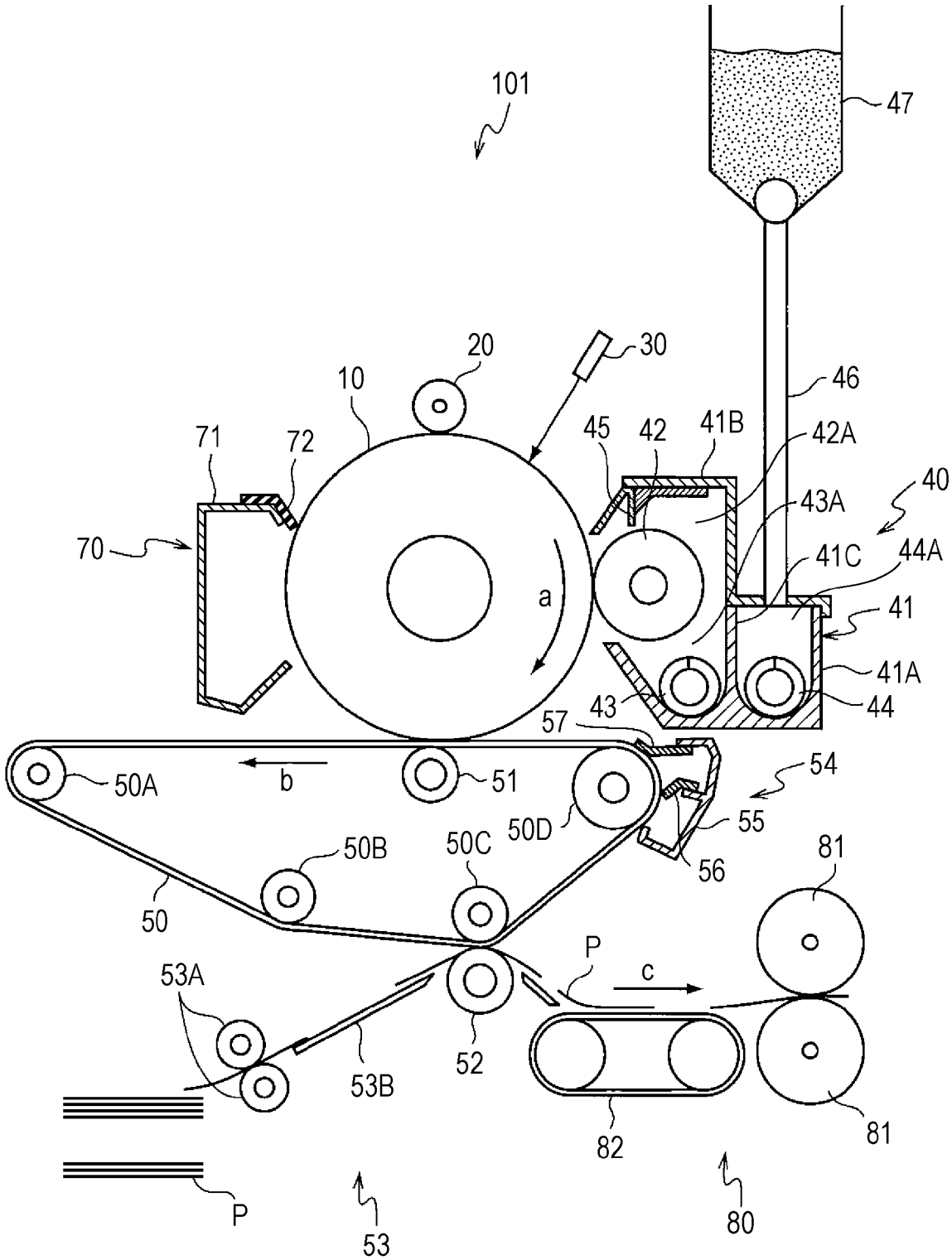
FIG. 1 is a schematic drawing showing a configuration of an image forming apparatus according to an exemplary embodiment of the present invention.

FIG. 1 is a schematic drawing showing a configuration of an image forming apparatus according to an exemplary embodiment of the present invention.

As shown in FIG. 1, an image forming apparatus 101 according to an exemplary embodiment of the present invention includes an electrophotographic photoconductor 10 (an example of an image carrier) that is rotated in a clockwise direction, for example, as shown by arrow a, a charging device 20 (an example of a charging unit) that is provided above the electrophotographic photoconductor 10 so as to face the electrophotographic photoconductor 10 and charge the surface of the electrophotographic photoconductor 10, an exposure device 30 (an example of a latent image forming unit) that forms an electrostatic latent image by exposure of the surface of the electrophotographic photoconductor 10 charged by the charging device 20, a development device 40 (an example of a development unit) that forms a toner image on the surface of the electrophotographic photoconductor 10 by adhering a toner contained in a developer to the electrostatic latent image formed by the exposure device 30, a belt-shaped intermediate transfer body 50 that travels in a direction shown by arrow b while being in contact with the surface of the electrophotographic photoconductor 10 and to which the toner image formed on the surface of the electrophotographic photoconductor 10 is transferred, and a photoconductor cleaning device 70 (an example of a cleaning unit) that cleans the surface of the electrophotographic photoconductor 10.

The charging device 20, the exposure device 30, the development device 40, the intermediate transfer body 50, and the photoconductor cleaning device 70 are disposed around the circumference of the electrophotographic photoconductor 10, for example, in a clockwise direction.

The intermediate transfer body 50 is maintained by, for example, support rollers 50A and 50B, a back roller 50C, and a drive roller 50D while being imparted with tension from the inside. At the same time, the intermediate transfer body 50 is driven in the direction shown by arrow b with rotation of the drive roller 50D. In addition, a first transfer device 51 is provided at a position that faces the electrophotographic photoconductor 10 inside the intermediate transfer body 50 so that the intermediate transfer body 50 is charged to polarity different from the charge polarity of a toner and the toner on the electrophotographic photoconductor 10 is attracted to the surface (outer surface) of the intermediate transfer body 50. Further, a second transfer device 52 is provided below and outside the intermediate transfer body 50 to face the back roller 50C so that recording paper P (an example of a recording medium) is charged to polarity different from the charge polarity of the toner and the toner image formed on the intermediate transfer body 50 is transferred to the recording paper P.

Further, a recording paper feed device 53 that feeds the recording paper P to the second transfer device 52 and a fixing device 80 that fixes the toner image while transporting the recording paper P having the toner image formed thereon by the second transfer device 52 are provided below the intermediate transfer body 50.

The recording paper feed device 53 includes a pair of transport rollers 53A and a guide plate 53B that guides the recording paper P transported by the transport rollers 53A toward the second transfer device 52. On the other hand, the fixing device 80 includes a pair of fixing rollers 81 as heating rollers that fix the toner image by heating and pressing the recording paper P to which the toner image is transferred by the second transfer device 52, and a transport belt 82 that transports the recording paper P to the fixing rollers 81.

The recording paper P is transported in a direction shown by arrow c by the recording paper feed device 53, the second transfer device 52, and the fixing device 80.

Further, an intermediate transfer body cleaning device 54 that includes cleaning blades (a first cleaning blade 56 and a second cleaning blade 57) is provided on the intermediate transfer body 50 so that the toner remaining on the intermediate transfer body 50 after the toner image is transferred to the recording paper P by the second transfer device 52.

The principal component members of the image forming apparatus 101 according to an exemplary embodiment of the present invention are described in detail below.

—Developer—

The developer may be a one-component developer containing a toner alone or a two-component developer containing a toner and a carrier.

First, the toner is described.

The toner contains toner particles containing a binder resin and, if required, other additives such as a colorant, a release agent, etc., and an external additive.

As the external additive, inorganic particles are used.

The toner particles are described.

Examples of the binder resin includes, but are not particularly limited to, homopolymers and copolymers of styrenes (e.g., styrene, chlorostyrene, and the like), monoolefins (e.g., ethylene, propylene, butylene, isoprene, and the like), vinyl esters (e.g., vinyl acetate, vinyl propionate, vinyl benzoate, vinyl butyrate, and the like), α-methylene aliphatic monocarboxylic acid esters (e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like), vinyl ethers (e.g., vinyl methyl ether, vinyl ethyl ether, vinyl butyl ether, and the like), vinyl ketones (e.g., vinyl methyl ketone, vinyl hexyl ketone, vinyl isopropenyl ketone, and the like), and the like; and polyester resins produced by copolymerization of dicarboxylic acids and diols.

Typical examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene resins, polypropylene resins, polyester resins, and the like.

Other typical examples of the binder resin include polyurethane, epoxy resins, silicone resins, polyamide, modified rosin, paraffin wax, and the like.

Examples of the other additive include a colorant, a release agent, a magnetic material, a charge control agent, an inorganic powder, and the like.

Typical examples of the colorant include magnetic powders (e.g., magnetite, ferrite, and the like), carbon black, aniline blue, calcoil blue, chrome yellow, ultramarine blue, DuPont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, C. I. Pigment Blue 15:3, and the like.

Examples of the release agent include, but are not limited to, hydrocarbon wax; natural wax such as carnauba wax, rice wax, candelilla wax, and the like; synthetic or mineral-petroleum wax such as montan wax and the like; and ester wax such as fatty acid esters, montanoic acid esters, and the like.

The characteristics of the toner particles are described.

The toner particles preferably have an average shape factor (shape factor=number-average shape factor represented by $(ML^2/A)\times(\pi/4)\times100$ wherein ML represents the maximum length of particles, and A represents the projected area of particles) of 100 or more and 150 or less. The average shape factor is more preferably 105 or more and 145 or less and still more preferably 110 or more and 140 or less.

The toner particles preferably have a volume-average particle diameter D50v of 2.0 μm or more and 10 μm or less, preferably 2.0 μm or more and 6.5 μm or less, more preferably 2.0 μm or more and 5.5 μm or less, and most preferably 2.0 μm or more and 4.5 μm or less. The lower limit of the volume-average particle diameter D50v is preferably 2.5 μm or more and more preferably 3.0 μm or more.

The method for measuring the volume-average particle diameter D50v of the toner particles is as follows.

First, 0.5 mg or more and 50 mg or less of a measurement sample is added to 2 ml of a 5 mass % aqueous solution of a surfactant (desirably, sodium alkylbenzene sulfonate) as a dispersant, and the resultant mixture is added to 100 ml or more and 150 ml or less of an electrolytic solution. The electrolytic solution in which the measurement sample is suspended is subjected to dispersion treatment for about 1 minute using an ultrasonic disperser. A particle size distribution of particles within the particle diameter range of 2.0 μm or more and 60 μm or less is measured with Coulter Multisizer II (manufactured by Beckmann-Coulter Inc.) using an aperture having a diameter of 100 μm. The number of particles to be measured is about 50,000.

A volume accumulation distribution from the smaller particle size is plotted against the particle size ranges (channels) into which the measured particle size distribution is divided. The particle diameter corresponding to an accumulation of 50% is defined as the volume-average particle diameter D50v.

The external additive is described.

For example, inorganic particles are used as the external additive.

Examples of the inorganic particles used as the external additive include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The volume-average particle diameter of the inorganic particles as the external additive is, for example, in the range of 7 nm or more and 60 nm or less, and preferably 10 nm or more and 50 nm or less.

The surfaces of the inorganic particles used as the external additive may be previously hydrophobized. The hydrophobic treatment is performed by, for example, immersing the inorganic particles in a hydrophobizing agent. Examples of the hydrophobizing agent include, but are not limited to, a silane coupling agent, silicone oil, a titanate coupling agent, an aluminum coupling agent, and the like. These may be used alone or in combination of two or more.

The amount of the inorganic particles externally added as the external additive is, for example, 0.5 parts by mass or more and 3.0 parts by mass or less, preferably 0.8 parts by mass or more and 2.5 parts by mass or less, relative to 100 parts by mass of the toner particles.

Lubricant particles (solid lubricant particles) may be also used as the external additive.

Examples of the lubricant particles used as the external additive include particles of fluorocarbon resins, polyolefins, fatty acid metal salts, and the like.

Examples of the fluorocarbon resins include polytetrafluoroethylene (PTFE), tetrafluoroethylene-perfluoroalkylvinyl ether copolymers (PFA), tetrafluoroethylene-hexafluoropropylene copolymers (FEP), polyvinylidene fluoride (PVDF), tetrafluoroethylene-ethylene copolymers (ETFE), polychlorotrifluoroethylene (PCTFE), chlorotrifluoroethylene-ethylene copolymers (ECTFE), polyvinyl fluoride (PVF), fluoroolefin-vinyl ether copolymers, vinylidene fluoride-tetrafluoroethylene copolymers, and vinylidene fluoride-hexafluoropropylene copolymers.

Examples of the polyolefins include waxes such as paraffin wax, paraffin latex, microcrystalline wax, and the like. In particular, polyethylene wax and polypropylene wax are used.

Examples of the fatty acid metal salts include salts of stearic acid with metals such as zinc, cadmium, barium, lead, iron, nickel, cobalt, copper, aluminum, magnesium, and the like; dibasic lead stearate; salts of oleic acid with metals such as zinc, magnesium, iron, cobalt, copper, lead, calcium, and the like; salts of palmitic acid with metals such as aluminum, calcium, and the like; lead caprylate; lead caproate; zinc linoleate; cobalt linoleate; calcium ricinoleate; salts of lichinoleic acid with metals such as zinc, cadmium, and the like; and mixtures thereof.

The volume-average particle diameter of the lubricant particles added as the external additive is, for example, 0.1 μm or more and 10 μm or less, preferably 0.3 μm or more and 6 μm or less, and more preferably 4 μm or more and 6 μm or less.

The amount of the lubricant particles externally added as the external additive is, for example, 0.1 parts by mass or more and 5 parts by mass or less and preferably 0.12 parts by mass or more and 0.5 parts by mass or less, based on 100 parts by mass of the toner particles.

If required, other external additives (for example, inorganic particles having a volume-average particle diameter of 80 nm or more and 400 nm or less) may be added.

The volume-average particle diameter of the external additive is measured with a laser diffraction particle size distribution analyzer (LA-700: manufactured by Horiba Ltd.).

Specifically, a dispersion solution of a sample is prepared so that the solid content is about 2 g, and ion exchange water is added to the dispersion solution until about 40 ml. The resultant solution is poured into a cell until a proper concentration is obtained, and then the concentration in the cell is stabilized by waiting for about 2 minutes, followed by measurement. The volume-average particle sizes of the channels are accumulated from the smaller volume-average particle size, and the particle size corresponding to an accumulation of 50% is defined as the volume-average particle diameter.

The method for producing the toner is described.

First, the toner particles are not particularly limited by the production method. For example, the toner particles are produced by a kneading-grinding method of kneading, grinding, and classifying a mixture of a binder resin, a colorant, and a release agent, and if required, a charge control agent; a method of changing the shape of particles, which are produced by the kneading-grinding method, by mechanical impact force or heat energy; an emulsion polymerization aggregation method of emulsion-polymerizing a polymerizable monomer of a binder resin, mixing the resultant dispersion solution with a dispersion solution containing a colorant and a release agent, and if required, a charge control agent, followed by aggregation and heat-fusion; a suspension polymerization method of suspending a solution of a polymerizable monomer for forming a binder resin, a colorant, and a release agent, and if required, a charge control agent in an aqueous solvent, followed by polymerization; or a dissolution suspension method of suspending a solution of a binder resin, a colorant, and a release agent, and if required, a charge control agent in an aqueous solvent, followed by granulation.

Further, a known method such as a production method of adhering aggregate particles to the toner particles, which are produced by the above-described method and used as cores, followed by heat-fusion to form a core-shell structure may be used. As the toner producing method, from the viewpoint of shape control and particle size distribution control, the suspension polymerization method, the emulsion polymerization aggregation method, and the dissolution suspension method are desired because of production using an aqueous solvent. Among these, the emulsion polymerization aggregation method is particularly desired.

In addition, the toner is produced by mixing the toner particles with the external additives using a Henschel mixer or a V blender. When the toner particles are produced by a wet method, the external additives may be added by a wet method.

Next, the carrier is described.

The carrier is not particularly limited, and a known carrier may be used. Examples of the carrier include a resin-coated carrier, a magnetic dispersion-type carrier, a resin dispersion-type carrier, and the like.

In addition, the mixing ratio (weight ratio) of the toner to the carrier (toner:carrier) in the two-component developer is, for example, preferably in the range of about 1:100 to 30:100, and more preferably in the range of about 3:100 to 20:100.

—Electrophotographic Photoconductor—

The electrophotographic photoconductor 10 is, for example, an inorganic photoconductor including a photosensitive layer that is provided on a conductive substrate and composed of an inorganic material, or an organic photoconductor including a photosensitive layer that is composed of an organic material. The organic photoconductor is, for example, a separated-function photoconductor including a charge generating layer that generates charges by conductive exposure and a charge transport layer that transports charges, both layers being laminated on a conductive substrate, or a photoconductor including a single photosensitive layer that functions to generate charges and transports charges and that is provided on the conductive substrate. The inorganic photoconductor is, for example, a photoconductor including a photosensitive layer that is provided on a conductive substrate and that is composed of amorphous silicon.

In addition, the shape of the electrophotographic photoconductor 10 is not limited to a cylindrical shape, and for example, a known shape such as a sheet shape, a plate shape, or the like may be used.

—Charging Device—

The charging device 20 is, for example, a contact charger using a conductive charging roller, a charging brush, a charging film, a charging rubber blade, or a charging tube. Also, the charging device 20 is, for example, a known charger such as a noncontact roller charger, a scorotron charger or a corotron charger using corona discharge. The contact charger is desired as the charging device 20.

A charger of a system in which a voltage generated by superimposing alternating current on direct current is applied easily produces a discharge product. However, in the exemplary embodiment, even when such a system is used, adhesion and deposition of the discharge product on the electrophotographic photoconductor 10 is suppressed, thereby suppressing uncopied spots on an image.

—Exposure Device—

As the exposure device 30, for example, an optical-system device may be used, in which the surface of the electrophotographic photoconductor 10 is exposed in an image form to light of a semiconductor laser, a LED, or a liquid crystal shutter. The wavelength of a light source falls in the spectral sensitivity region of the electrophotographic photoconductor 10. As the wavelength of the semiconductor laser, for example, a near-infrared region having an oscillation wavelength at about 780 nm may be used. However, the wavelength is not limited to this, and a laser having an oscillation wavelength of the order of 600 nm or a blue laser having an oscillation wavelength of 400 nm or more and 450 nm or less may be used. In addition, for example, a surface emitting laser light source of a type that emits multi-beams for forming a color image is effective as the exposure device 30.

—Development Device—

The development device 40 is, for example, disposed to face the electrophotographic photoconductor 10 within a development region, and includes, for example, a development container 41 (development device body) that contains the developer (two-component developer) containing the toner and the carrier, and a replenishing developer container (toner cartridge) 47. The development container 41 includes a development container body 41A and a development container cover 41B that closes the upper end of the development container body 41A.

The development container body 41A includes, for example, a development roll chamber 42A that contains a development roll (an example of a development support) 42 therein, and a first stirring chamber 43A and a second stirring chamber 44A adjacent to the first stirring chamber 43A, both stirring chambers 43A and 43B being adjacent to the development roll chamber 42A. In addition, a layer thickness regulating member 45 is provided in the development roll chamber 42A in order to regulate the thickness of a developer layer on the surface of the development roll 42, for example, when the development container cover 41B is attached to the development container body 41A.

The first stirring chamber 43A and the second stirring chamber 44A are partitioned by, for example, a partition wall 41C. Although not shown in the drawing, the first stirring chamber 43A and the second stirring chamber 44A are communicated with each other through openings provided at both ends of the partition wall 41C in the longitudinal direction (longitudinal direction of the development device), forming a circulation stirring chamber (43A+44A) by the first stirring chamber 43A and the second stirring chamber 44A.

The development roll 42 is disposed in the development roll chamber 42A so as to face the electrophotographic photoconductor 10. Although not shown in the drawing, the development roll 42 includes a magnetic roll (fixed magnet) having magnetism and a sleeve provided on the outside of the magnetic roll. In the first stirring chamber 43A, the developer is attracted to the surface of the development roll 42 by virtue of the magnetic force of the magnetic roll and transported to the development region. The roll axis of the development roll 42 is rotatably supported by the development container body 41A. In this case, the development roll 42 and the electrophotographic photoconductor 10 are rotated in the same direction so that in the opposing portion therebetween, the developer attracted to the surface of the development roll 42 is transported to the development region in the direction opposite to the moving direction of the electrophotographic photoconductor 10.

In addition, a bias power supply (not shown) is connected to the sleeve of the development roll 42 so as to apply a development bias. In this exemplary embodiment, a bias generated by superimposing an alternating-current component (AC) on a direct-current component (DC) is applied so that an alternating electric field is applied to the development region.

In addition, a first stirring member 43 (stirring and transport member) and a second stirring member 44 (stirring and transport member) are disposed in the first stirring chamber 43A and the second stirring chamber 44A, respectively, so that the developer is transported under stirring. The first stirring member 43 includes a first rotational shaft extending in the axial direction of the development roll 42 and a stirring and transport blade (projecting portion) helically fixed to the periphery of the rotational shaft. Similarly, the second stirring member 44 includes a second rotational shaft and a stirring and transport blade (projecting portion). The stirring members are rotatably supported by the development container body 41A. The first stirring member 43 and the second stirring member 44 are disposed so that the developers in the first stirring chamber 43A and in the second stirring chamber 44A are transferred in opposite directions by the rotations thereof.

In addition, an end of a replenishing transport path 46 is connected to one of the ends of the second stirring chamber 44A in the longitudinal direction in order to supply the replenishing developer, that contains a replenishing toner and a replenishing carrier, to the second stirring chamber 44A. Further, a replenishing developer container 47 that contains the replenishing developer is connected to the other end of the replenishing transport path 46.

The replenishing developer is supplied from the replenishing developer container (toner cartridge) 47 to the development device 40 (second stirring chamber 44A) through the replenishing transport path 46.

—Transfer Device—

The first transfer device 51 and the second transfer device 52 are each, for example, a contact transfer charger using a belt, a roller, a film, or a rubber blade, or a known transfer charger such as a scorotron transfer charger or a corotron transfer charger using corona discharge.

—Intermediate Transfer Body—

Figure 2:
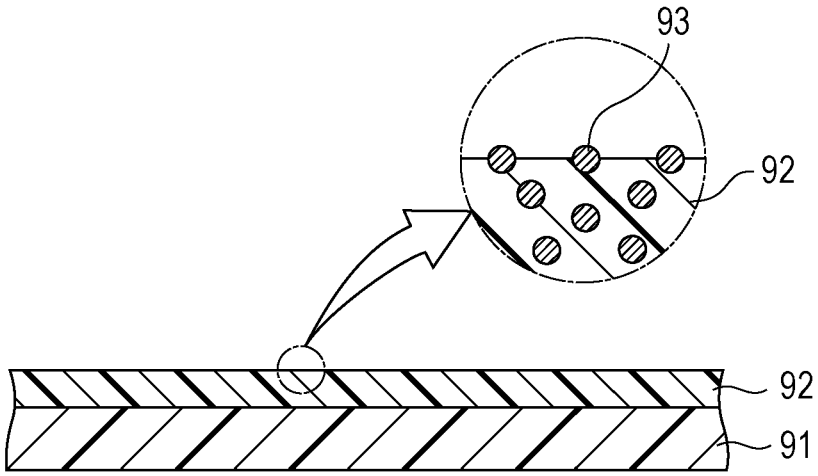
FIG. 2 is a schematic sectional view showing an intermediate transfer body of an image forming apparatus according to an exemplary embodiment of the present invention.

As shown in FIG. 2, the intermediate transfer body 50 includes, for example, an endless belt composed of a laminate of a base layer 91 having a thickness of 30 μm or more and 80 μm or less and the outermost layer 92 provided on the periphery of the base layer 91 and having a thickness of 5 μm or more and 70 μm or less.

As the outermost layer 92, a layer containing a resin material and fluorocarbon resin particles is used. Therefore, the surface (outer surface) of the intermediate transfer body 50 contains the resin material and the fluorocarbon resin particles.

In FIG. 2, reference numeral 93 denotes the fluorocarbon resin particles.

The constituent materials and characteristics of the intermediate transfer body 50 are described below.

First, the outermost layer 92 is described.

The outermost layer 92 contains the resin material, the fluorocarbon resin particles, and if required, other additives such as a conductive agent, etc.

The resin material preferably has a Young's modulus of 3500 MPa or more and more preferably 4000 MPa or more depending on the belt thickness, because the mechanical properties as a belt are satisfied. The resin material is not limited as long as it satisfies the Young's modulus. Examples thereof include polyimide resins, polyamide resins, polyamide-imide resins, polyether-ether-ester resins, polyarylate resins, polyester resins, and polyester resins containing a reinforcing material.

The Young's modulus is determined from a gradient of a tangent drawn to a curve within an initial strain region of a stress-strain curve obtained by a tensile test according to JIS K7127 (1999). The measurement is performed using a strip specimen (width 6 mm, length 130 mm) and dumbbell No. 1 under the conditions including a test speed of 500 mm/min and a thickness set to the thickness of the belt body.

Among these resin materials, the polyimide resins are desired. The polyimide resins are materials with high Young's modulus and thus produce less deformation than the other resins during driving (stress of the support roll, the cleaning blade, and the like), thereby forming the intermediate transfer body (belt) causing little image defects such as color shift.

Examples of the polyimide resins include imidized products of polyamic acids that are each a polymer of tetracarboxylic dianhydride and diamine compound. Specifically, the polyimide resins are produced by, for example, imidizing polyamic acids that are each prepared as a polyamic acid solution by polymerization reaction of equimolar amounts of a tetracarboxylic dianhydride and a diamine compound in a solvent.

Examples of the tetracarboxylic dianhydride include those represented by the following general formula (I).

General Formula (I)

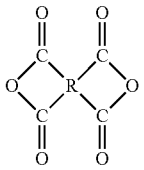

In the general formula (I), R is a tetravalent organic group such as an aromatic group, an aliphatic group, an alicyclic group, a combination of aromatic and aliphatic groups, or such a group having a substituent.

Specific examples of the tetracarboxylic dianhydride include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)sulfonic dianhydride, perylene-3,4,9,10-tetracarboxylic dianhydride, bis(3,4-dicarboxyphenyl)ether dianhydride, ethylenetetracarboxylic dianhydride, and the like.

Specific examples of the diamine compound include 4,4'-diaminodiphenyl ether, 4,4'-diaminodiphenyl methane, 3,3'-diaminodiphenyl methane, 3,3'-dichlorobenzidine, 4,4'-diaminodiphenyl sulfide, 3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminodiphenylsulfone, 4,4'-diaminodiphenylpropane, 2,4-bis(β-amino-tert-butyl)toluene, bis(p-β-amino-tert-butylphenyl)ether, bis(p-β-methyl-δ-aminophenyl) benzene, bis-p-(1,1-dimethyl-5-amino-bentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptamethylenediamine, 2,11-diaminododecane, 1,2-bis-3-aminopropoxyethane, 2,2-dimethylpropylenediamine, 3-methoxyhexamethylenediamine, 2,5-dimethylheptamethylenediamine, 3-methylheptamethylenediamine, 5-methylnonamethylenediamine, 2,17-diaminoeicosadecane, 1,4-diaminocyclohexane, 1,10-diamino-1,10-dimethyldecane, 12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, $H_2N(CH_2)_3N(CH_3)_2(CH_2)_3NH_2$, and the like.

In the polymerization reaction of the tetracarboxylic dianhydride and the diamine, a polar solvent (organic polar solvent) is preferably used as a solvent from the viewpoint of solubility, etc. As the polar solvent, N,N-dialkylamides may be used. Specific examples thereof include N,N-dialkylamides having a low molecular weight, such as N,N-dimethylformamide, N,N-dimethylacetamide, N,N-diethylformamide, N,N-diethylacetamide, N,N-dimethylmethoxyacetamide, dimethylsulfoxide, hexamethylphosphortriamide, N-methyl-2-pyrrolidone, pyridine, tetramethylenesulfone, dimethyltetramethylene sulfone, and the like. These may be used alone or in combination of two or more.

The content of the polyimide resin is, for example, 10% by mass or more and 80% by mass or less, preferably 20% by mass or more and 75% by mass or less, and more preferably 40% by mass or more and 70% by mass or less based on the total of the constituents of the layer.

These polyimide resins may be used alone or in combination of two or more.

Besides the polyimide resin, another resin material may be combined within a range where retention of releasability is not impaired. Examples of the other resin include polyamide resins, polyamide-imide resins, polyether-ether-ester resins, polyarylate resins, polyester resins, polyester resins containing a reinforcing material, and the like.

The fluorocarbon resin particles are described.

Examples of the fluorocarbon resin particles include particles of tetrafluoroethylene resins, chlorotrifluoroethylene resins, hexafluoropropylene resins, vinyl fluoride resins, vinylidene fluoride resins, dichlorodifluoroethylene resins, and copolymers thereof.

Among these resins, polytetrafluoroethylene (tetrafluoroethylene resins "PTFE"), a tetrafluoroethylene-hexafluoropropylene-perfluoroalkylvinyl ether copolymer (FEP), and a tetrafluoroethylene-perfluoroalkylvinyl ether copolymer (PFA) are desired for the fluorocarbon resin particles.

The fluorocarbon resin particles are contained as initial particles, secondary particles having a secondary particle diameter (preferably 1 μm or less and more preferably 0.5 μm or less), or a mixture thereof.

This represents that the fluorocarbon resin particles are contained and dispersed as initial particles, secondary particles (aggregates of at least two initial particles), or a mixture thereof, and that the secondary particle diameter of at least aggregate particles is in the above-described range, i.e., the fluorocarbon resin particles are dispersed with suppressed aggregation.

The initial particle diameter (particle diameter without aggregation) of the fluorocarbon resin particles is 0.1 μm or more and 0.3 μm or less.

Each of the initial particle diameter and the secondary particle diameter of the fluorocarbon resin particles is determined by preparing a specimen from the outermost layer, observing the specimen with SEM (scanning electron microscope) at, for example, a magnification of ×5000 to measure the maximum diameter of each of the fluorocarbon resin particles in the state of initial particles or aggregate particles, and averaging the maximum diameters of 50 particles. In addition, a secondary electron image is observed with SEM (JSM-6700F manufactured by JEOL, Ltd.) at an acceleration voltage of 5 kV.

The content of the fluorocarbon resin particles is, for example, 1% by mass or more and 50% by mass or less, preferably 2% by mass or more and 45% by mass or less, and more preferably 3% by mass or more and 40% by mass or less based on the total of the constituents of the layer.

The type of the fluorocarbon resin particles may be one or combination of two or more types.

In order that the fluorocarbon resin particles are dispersed (contained) as described above, for example, a fluorinated graft polymer may be used as a dispersant.

As the fluorinated graft polymer, a copolymer of a macromonomer having a polymerizable functional group at one of the ends of its molecular chain and a polymerizable fluorinated monomer having an alkyl fluoride group may be used.

Specific examples of the fluorinated graft polymer include graft copolymers each composed of a macromonomer, such as a polymer or copolymer of an acrylate, a methacrylate, a styrene compound, or the like, and a fluorinated monomer such as perfluoroalkylethyl methacrylate, perfluoroalkyl methacrylate, or the like.

The polymerization ratio of the macromonomer and the polymerizable fluorinated monomer is, for example, 10% by mass or more and 50% by mass or less, preferably 10% by mass or more and 40% by mass or less, and more preferably 10% by mass or more and 30% by mass or less, in terms of the fluorine content in the fluorinated graft polymer.

The molecular weight of the fluorinated graft polymer is, for example, 5,000 or more and 20,000 or less, preferably 5,000 or more 17,500 or less, and more preferably 5,000 or more and 12,000 or less, in terms of number-average molecular weight.

The amount of the fluorinated graft polymer is, for example, 0.1% by mass or more and 10% by mass or less based on the fluorocarbon resin particles.

The conductive agent is described.

As the conductive agent, a conductive (for example, a volume resistivity of $10^7$ Ω·cm, this applies to the description below) or semiconductive (for example, a volume resistivity of less than $10^7$ Ω·cm or more and $10^{13}$ Ω·cm or less, this applies to the description below) powder (including particles having an initial particle diameter of less than 10 μm, preferably 1 μm or less) may be used.

Examples of the conductive agent include, but are not particularly limited to, carbon black (e.g., Ketjenblack, acetylene black, carbon black with oxidized surfaces, and the like), metals (e.g., aluminum, nickel, and the like), metal oxide compounds (e.g., yttrium oxide, tin oxide, and the like), ionic conductive materials (e.g., potassium titanate, LiCl, and the like), conductive polymers (e.g., polyaniline, polypyrrole, polysulfone, polyacetylene, and the like).

The conductive agent is selected according to the purpose of use, but is preferably oxidized carbon black of pH 5 or less (preferably pH 4.5 or less and more preferably pH 4.0 or less), for example, carbon black with surfaces imparted with carboxyl groups, quinone groups, lactone groups, or hydroxyl groups, from the viewpoint of stability of electric resistance with time, and electric field dependence of suppressing electric field concentration due to a transfer voltage. In addition, from the viewpoint of imparting electric durability, the conductive agent is preferably a conductive polymer (for example, polyaniline).

The content of the conductive agent is, for example, 1% by mass or more and 50% by mass or less, preferably 2% by mass or more and 40% by mass or less, and more preferably 4% by mass or more and 30% by mass or less based on the total of the constituents of the layer.

These conductive agents may be used alone or in combination of two or more.

Next, the base layer 91 is described.

The base layer 91 includes a resin material. If required, the base layer 91 also includes a conductive agent.

The resin material is described.

The resin material preferably has a Young's modulus of 3500 MPa or more and more preferably 4000 MPa or more depending on the belt thickness because the mechanical properties as a belt are satisfied. The resin material is not limited as long as it satisfies the Young's modulus. Examples thereof include polyimide resins, polyamide resins, polyamide-imide resins, polyether-ether-ester resins, polyarylate resins, polyester resins, and polyester resins containing a reinforcing material.

The Young's modulus is determined from a gradient of a tangent drawn to a curve within an initial strain region of a stress-strain curve obtained by a tensile test according to JIS K7127 (1999). The measurement is performed using a strip specimen (width 6 mm, length 130 mm) and dumbbell No. 1 under the conditions including a test speed of 500 mm/min and a thickness set to the thickness of the belt body.

Among these resin materials, the polyimide resins are desired. The polyimide resins are materials with high Young's modulus and thus produce less deformation than the other resins during rotational driving of the belt. When the outermost layer 92 is composed of a polyimide resin, the base layer 91 corresponding to a lower layer in contact with the outermost layer 92 is also composed of a polyimide resin, and thus adhesion between the outermost layer 92 and the base layer 91 provided as the lower layer may be improved, thereby suppressing separation between the layers.

As the polyimide resin, the same as those for the outermost layer 92 may be used.

The conductive agent is described.

Also, as the conductive agent, the same as those for the outermost layer 92 may be used.

Next, the characteristics of the intermediate transfer body 50 are described.

The surface resistivity of the surface (outer surface) of the intermediate transfer body 50 is preferably 9 (Log Ω/□) or more and 13 (Log Ω/□) or less and more preferably 10 (Log Ω/□) or more and 12 (Log Ω/□) or less, in terms of common logarithm value.

The method for measuring the surface resistivity is as follows. According to JIS K6911, measurement is performed using a circular electrode (for example, Hiresta-IP "UR Probe" manufactured by Mitsubishi Chemical Corporation).

The volume resistivity of the whole intermediate transfer body 50 is preferably 8 (Log Ω/cm) or more and 13 (Log Ω/cm) or less in terms of common logarithm value.

The volume resistivity is measured using a circular electrode (for example, Hiresta-IP "UR Probe" manufactured by Mitsubishi Chemical Corporation) according to JIS K6911.

The intermediate transfer body 50 composed of a laminate of the two layers including the base layer 91 and the outermost layer 92 is described above, but the configuration is not limited to this. The intermediate transfer body 50 may be composed of a laminate of two or more layers (for example, an intermediate layer is provided between the outermost layer 92 and the base layer 91, or the base layer 91 is composed of a laminate of two or more layers) as long as it includes, as the outermost layer 92, a layer containing a resin and fluorocarbon resin particles.

The intermediate transfer body 50 may be composed of a single layer containing a resin and fluorocarbon resin particles.

—Photoconductor Cleaning Device—

The photoconductor cleaning device 70 is configured to include, for example, a housing 71 and a cleaning blade 72 provided to project from the housing 71.

The cleaning blade 72 may be supported at the end of the housing 71 or supported separately by a support member (holder). However, in this exemplary embodiment, the cleaning blade 72 supported at the end of the housing 71 is described.

The cleaning blade 72 is described.

The cleaning blade 72 includes a plate extending in a direction along the rotational axis of the electrophotographic photoconductor 10 and is provided upstream in the rotational direction (arrow a) of the electrophotographic photoconductor 10 so that the tip is put into contact with the electrophotographic photoconductor 10 while applying pressure thereto.

As the constituent material of the cleaning blade 72, urethane rubber, silicone rubber, fluorocarbon rubber, propylene rubber, and butadiene rubber may be used. Among these, urethane rubber is desired.

The urethane rubber (polyurethane) is not particularly limited as long as it is used for, for example, forming usual polyurethane. Examples thereof include urethane prepolymers each composed of polyol such as polyester polyol of polyethylene adipate or polycaprolactone, and isocyanate such as diphenylmethane diisocyanate, and polyurethane produced using a crosslinking agent as a raw material, such as 1,4-butanediol, trimethylolpropahe, or ethylene glycol, or a mixture thereof.

—Intermediate Transfer Body Cleaning Device—

Figure 3:
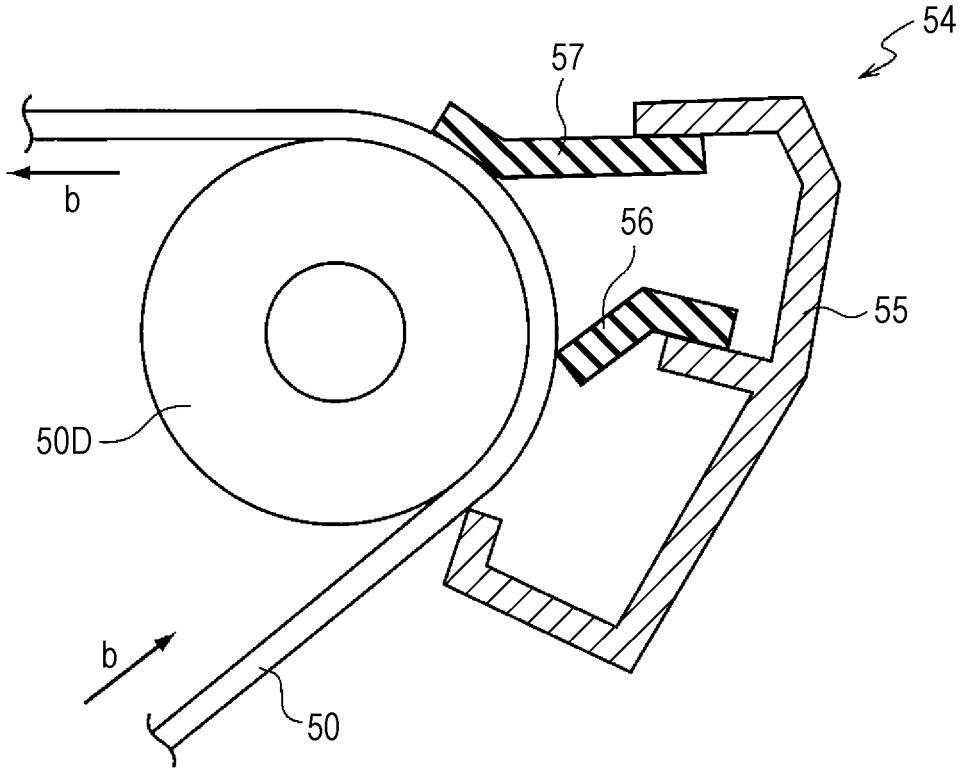
FIG. 3 is a schematic drawing showing a configuration of an intermediate transfer body cleaning device of an image forming apparatus according to an exemplary embodiment of the present invention.

As shown in FIG. 3, the intermediate transfer body cleaning device 54 is configured to include, for example, a housing 55, a first cleaning blade 56 disposed to project from the housing 55, and a second cleaning blade 57 disposed to project from the housing 55.

The first cleaning blade 56 is provided, for example, upstream of the second cleaning blade 57 in the rotational direction of the intermediate transfer body 50. That is, the second cleaning blade 57 is provided, for example, downstream of the first cleaning blade 56 in the rotational direction of the intermediate transfer body 50.

The first cleaning blade 56 and the second cleaning blade 57 may be supported at the end of the housing 55 or supported separately by a support member (holder). However, in this exemplary embodiment, the first cleaning blade 56 and the second cleaning blade 57 supported by the housing 55 are described.

The first cleaning blade 56 includes, for example, a plate extending in a direction along the width direction of the intermediate transfer body 50 and is provided in contact with the surface of the intermediate transfer body 50 so that the tip is directed to a direction opposite to the rotational direction of the intermediate transfer body 50. Specifically, the first cleaning blade 56 is provided, for example, so that the tip is directed to upstream in the rotational direction (arrow a) of the intermediate transfer body 50 and is struck on the surface of the intermediate transfer body 50.

The second cleaning blade 57 includes, for example, plate extending in a direction along the width direction of the intermediate transfer body 50 and is provided in contact with the surface of the intermediate transfer body 50 so that the tip is directed to the rotational direction of the intermediate transfer body 50. Specifically, the second cleaning blade 57 is provided, for example, so that the tip is directed to upstream in the rotational direction (arrow a) of the intermediate transfer body 50 and abuts on the surface of the intermediate transfer body 50.

In addition, the second cleaning blade 57 is provided, for example, so that among the opposing surfaces in the thickness direction of the tip, the surface facing the surface of the intermediate transfer body 50 is put into contact (i.e., surface contact) with the surface of the intermediate transfer body 50.

As the constituent material of the first cleaning blade 56 and the second cleaning blade 57, the same material as those exemplified for the cleaning blade 72 of the photoconductor cleaning device 70 may be used.

Next, an example of an image process (image forming method) of the image forming apparatus 101 according to the exemplary embodiment of the present invention is described.

In the image forming apparatus 101 according to the exemplary embodiment of the present invention, for example, first the electrophotographic photoconductor 10 is rotated along the direction show by arrow a and, at the same time, charged by the charging device 20.

The electrophotographic photoconductor 10 with the surface charged by the charging device 20 is exposed by the exposure device 30 to form a latent image on the surface.

When a portion where the latent image is formed in the electrophotographic photoconductor 10 approaches the development device 40, in the development device 40, a magnetic brush including the developer formed on the surface of the development roll 42 is brought into contact with the electrophotographic photoconductor 10, thereby adhering the toner to the latent image and forming a toner image.

When the electrophotographic photoconductor 10 on which the toner image is formed is further rotated in the direction of arrow a, the toner image is transferred to the surface (outer surface) of the intermediate transfer body 50 by the first transfer device 51.

When the toner image is transferred to the intermediate transfer body 50, the recording paper P is supplied to the second transfer device 52 by the recording paper feed device 53, and the toner image transferred to the intermediate transfer body 50 is transferred to the recording paper P by the second transfer device 52. Consequently, the toner image is formed on the recording paper P.

The formed toner image is fixed to the recording paper P by the fixing device 80.

After the toner image is transferred to the intermediate transfer body 50, the toner and discharge products remaining on the surface of the electrophotographic photoconductor 10 are removed with the cleaning blade 72 of the photoconductor cleaning device 70. Then, the electrophotographic photoconductor 10 from which the toner and discharge products remaining after transfer are removed with the photoconductor cleaning device 70 is again charged by the charging device 20 and then exposed by the exposure device 30 to form a latent image.

On the other hand, after the toner image is transferred to the intermediate transfer body 50, the toner etc. remaining on the surface of the intermediate transfer body 50 are removed with the second cleaning blade 57 together with the first cleaning blade 56 of the intermediate transfer body cleaning device 54. Then, a toner image is again transferred by the first transfer device 51 to the surface of the intermediate transfer body 50 from which the toner etc. remaining after transfer are removed with the intermediate transfer body cleaning device 54.

Figure 4A:
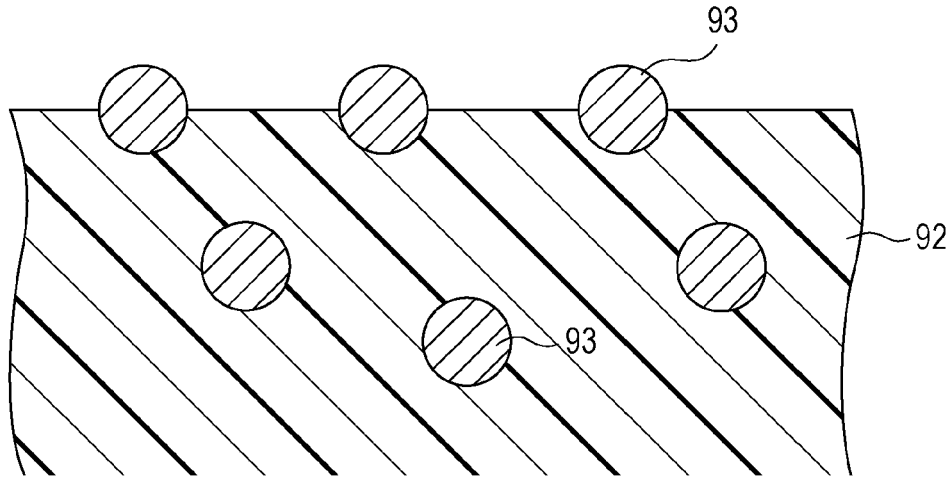
FIGS. 4A to 4C are schematic drawings illustrating the function of an image forming apparatus according to an exemplary embodiment of the present invention.

In the image forming apparatus 101 according to the exemplary embodiment described above, because the surface of the intermediate transfer body 50 is configured to include the resin material and the fluorocarbon resin particles, the fluorocarbon resin particles are exposed in the surface of the intermediate transfer body 50 to create a state in which releasability is exhibited in the early stage of the image forming process that is repeatedly performed (refer to FIG. 4A). Therefore, the efficiency of transfer of the toner image from the intermediate transfer body 50 to the recording paper P is increased.

However, when the surface of the intermediate transfer body 50 is cleaned with the cleaning blade (in the exemplary embodiment, the first cleaning blade 56 or the second cleaning blade 57) in the repeated image forming processes, the fluorocarbon resin particles exposed in the surface of the intermediate transfer body 50 may be cracked or separated by the mechanical load of cleaning. The cracked or separated fluorocarbon resin particles adhere to and are extended, due to the pressure of the cleaning blade on the electrophotographic photoconductor 10, in the peripheries of recessed portions that are formed in the surface of the intermediate transfer body 50 by cracking or separation of the fluorocarbon resin particles. As a result, the particles may be elongated to the downstream side in the rotational direction of the intermediate transfer body 50. Therefore, fluorocarbon resin films are formed in the peripheries of the recessed portions on the surface of the intermediate transfer body 50 and formed upstream of the recessed portions in the rotational direction of the intermediate transfer body 50 (refer to FIG. 4B).

After development with the developer containing the toner containing the toner particles and the inorganic particles added thereto, the toner image formed with the developer is first-transferred from the electrophotographic photoconductor 10 to the intermediate transfer body 50 and then second-transferred from the intermediate transfer body 50 to the recording paper P. After second transfer, the toner remaining on the surface of the intermediate transfer body 50 is cleaned off with the cleaning blade (in the exemplary embodiment, the first cleaning blade 56 or the second cleaning blade 57) when reaching the region of contact with the tip of the cleaning blade. At this time, the transfer residual toner stays at the tip of the cleaning blade, thereby producing accumulation of the toner. The accumulation contains the inorganic particles added as the external additive.

In this state, when the fluorocarbon resin particles are cracked or separated in the surface of the intermediate transfer body 50, the recesses are formed in the surface of the intermediate transfer body 50, and the inorganic fine particles added as the external additive slip through the cleaning blade from the recesses and the peripheries thereof and adhere to the surface of the intermediate transfer body 50. At this time, the inorganic particles added as the external additive are considered to enter the recesses formed in the surface of the intermediate transfer body 50 and to be held by the fluorocarbon resin films that are formed in the peripheries of the recesses and formed upstream of the recesses in the rotational direction of the intermediate transfer body 50 (refer to FIG. 4C).

In addition, fine irregularities are formed on the intermediate transfer body 50 by the inorganic particles that enter the recesses formed in the surface of the intermediate transfer body 50 and that are held by the fluorocarbon resin films formed in the peripheries of the recesses and formed upstream of the recesses in the rotational direction of the intermediate transfer body 50, thereby decreasing the contact area with the toner (toner image) transferred to the surface of the intermediate transfer body 50. As a result, releasability is exhibited and maintained.

Figure 4B:
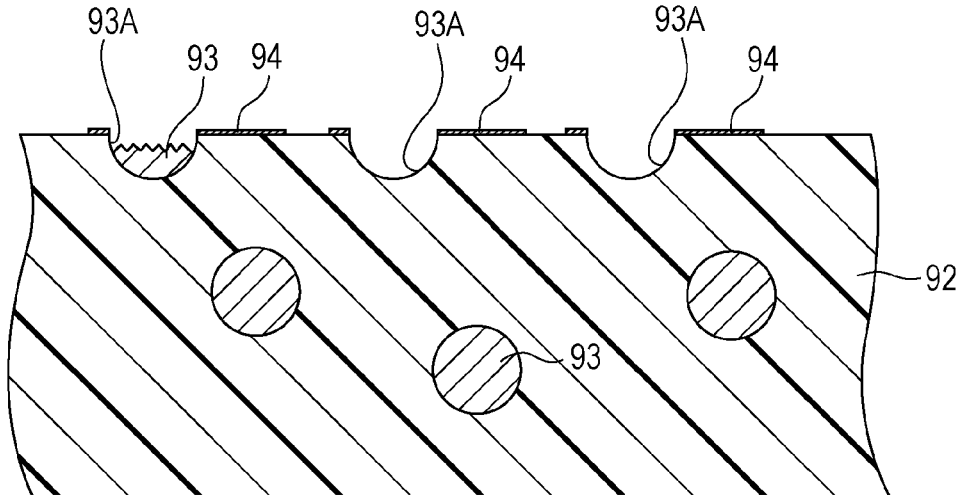
Figure 4C:
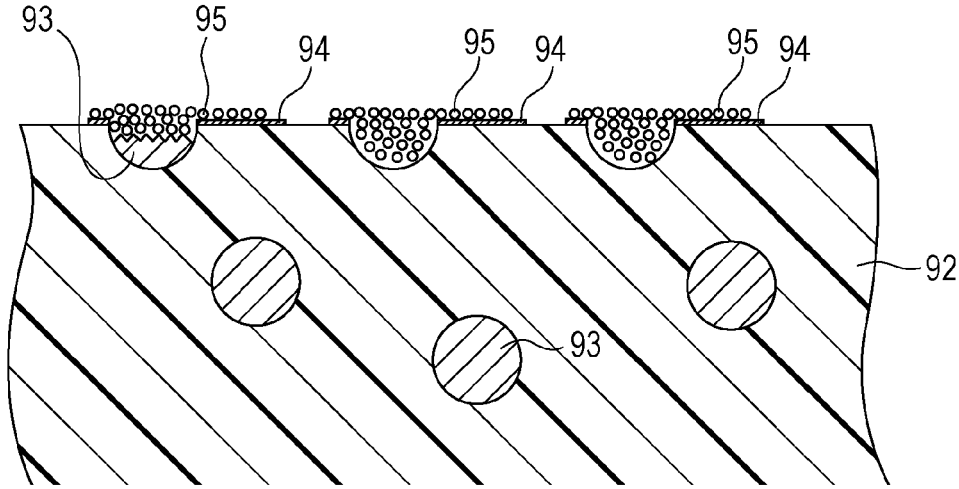

In FIGS. 4A to 4C, reference numeral 93 denotes the fluorocarbon resin particle; reference numeral 93A, the recess formed by cracking or separation of the fluorocarbon resin particle; reference numeral 94, the fluorocarbon resin film; and reference numeral 95, the inorganic particle.

Therefore, in the image forming apparatus 101 according to the exemplary embodiment of the present invention, the efficiency of transfer of the toner image from the intermediate transfer body 50 to the recording paper P (an example of recording medium) is maintained.

In particular, the image forming apparatus 101 according to the exemplary embodiment of the present invention is effective in applying a small-diameter toner (for example, a toner having a volume-average particle diameter of 2.0 μm or more and 6.5 μm or less) that easily produces a decrease in transfer efficiency. This is because a small-diameter toner is decreased in charge amount per toner particle with reduction in diameter, and thus electrostatic adhesive force to the image carrier is decreased, while non-electrostatic adhesive force, such as Van der Waals force (intermolecular force), to the intermediate transfer body 50 is increased, thereby easily making transfer by a transfer electric field more difficult than with a large-diameter toner.

In addition, the image forming apparatus 101 according to the exemplary embodiment of the present invention includes the two cleaning blades, i.e., the first cleaning blade 56 and the second cleaning blade 57, as the cleaning blade of the intermediate transfer body cleaning device 54.

Here, in view of the cleaning properties for the surface of the intermediate transfer body 50, the cleaning blade is provided in contact with the surface of the intermediate transfer body 50 so that the tip is directed to the direction opposite to the rotational direction of the intermediate transfer body 50 (hereinafter, this arrangement mode is referred to as the "doctor mode").

On the other hand, in view of maintaining releasability of the surface of the intermediate transfer body 50, the area of the fluorocarbon resin that holds the inorganic particles adhering thereto and added as the external additive is as large as possible in the surface of the intermediate transfer body 50. In order to realize this condition, the pressure of the cleaning blade on the surface of the intermediate transfer body 50 is increased.

However, when the pressure of the cleaning blade disposed in the doctor mode is increased, blade burr may occur.

Therefore, in the image forming apparatus 101 according to the exemplary embodiment of the present invention, as well as the first cleaning blade 56 disposed in the doctor mode in order to realize the high cleaning properties for the surface of the intermediate transfer body 50, the second cleaning blade 57 is provided downstream of the first cleaning blade 56 in the rotational direction of the intermediate transfer body 50 so as to be in contact with the surface of the intermediate transfer body 50 in the state where the tip of the second cleaning blade 57 is directed to the rotational direction of the intermediate transfer body 50 (hereinafter, this arrangement mode may be referred to as the "wiper mode").

The second cleaning blade 57 disposed in the wiper mode produces no blade burr even when the pressure on the surface of the intermediate transfer body 50 is increased. Therefore, in order to increase the area of the fluorocarbon resin films that hold the inorganic particles adhering thereto and added as the external additive on the surface of the intermediate transfer body 50, the pressure may be increased (for example, the pressure of the second cleaning blade 57 is 2 gf/mm or more and 5 gf/mm or less, while the pressure of the first cleaning blade 56 is 1 gf/mm or more and 3 gf/mm or less).

Figure 5A:
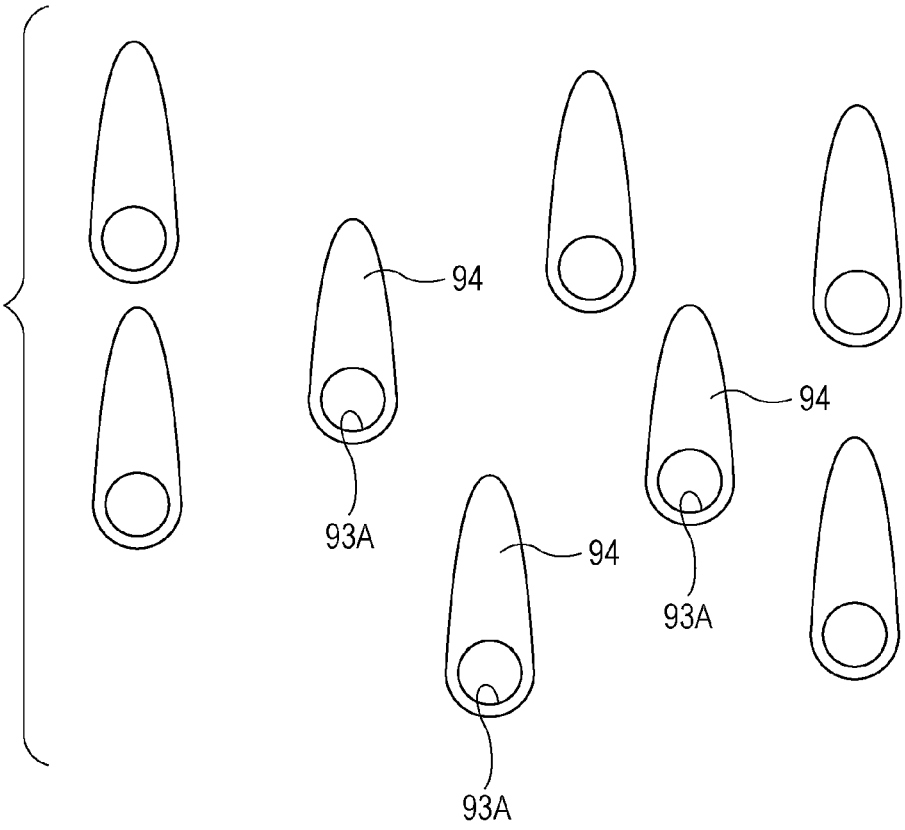
FIGS. 5A and 5B are schematic drawings illustrating a difference in the degree of elongation of fluorocarbon resin particles between a first cleaning blade and a second cleaning blade of an intermediate transfer body cleaning device in an image forming apparatus according to an exemplary embodiment of the present invention.

That is, the pressure of the second cleaning blade 57 on the surface of the intermediate transfer body 50 may be increased so that the area of the fluorocarbon resin films formed by the second cleaning blade 57 disposed in the wiper mode (refer to FIG. 5B) is larger than the area of the fluorocarbon resin films formed by the first cleaning blade 56 disposed in the doctor mode (refer to FIG. 5A).

Figure 5B:
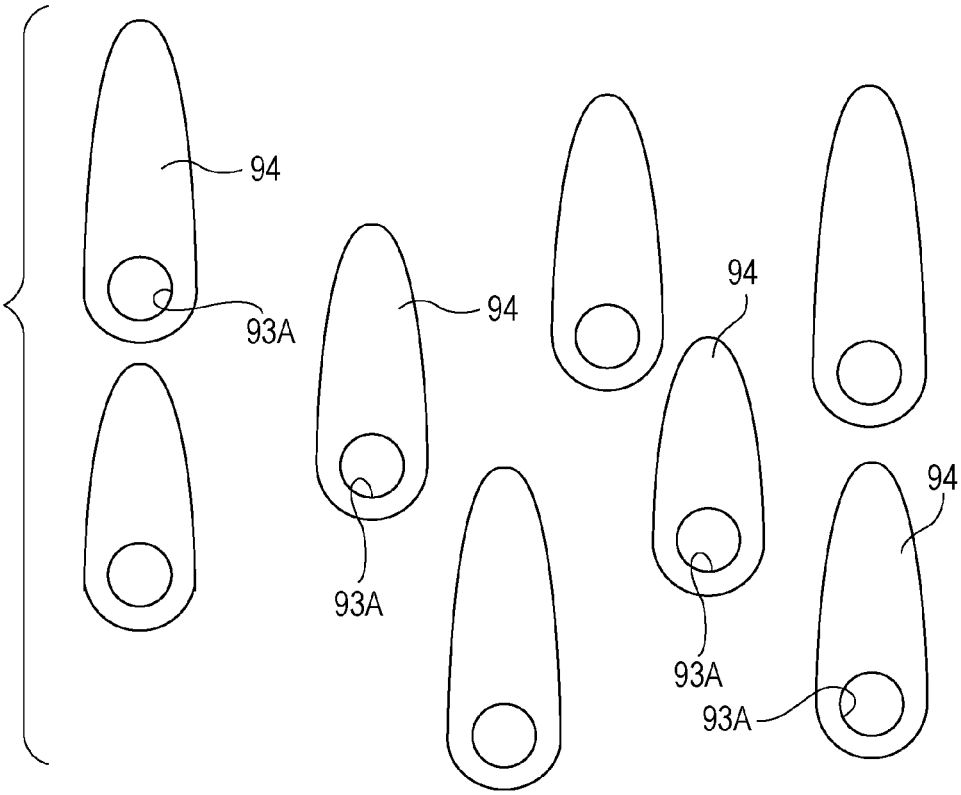

In FIGS. 5A and 5B, reference numeral 93A denotes the recess formed by cracking or separation of the fluorocarbon resin particle, and reference numeral 94 denotes the fluorocarbon resin film.

Therefore, in the image forming apparatus 101 according to the exemplary embodiment of the present invention, the two cleaning blades, i.e., the first cleaning blade 56 and the second cleaning blade 57, are provided as the cleaning blade of the intermediate transfer body cleaning device 54. In this case, the efficiency of transfer of the toner image from the intermediate transfer body 50 to the recording paper P (an example of the recording medium) is maintained as compared with the case where only the first cleaning blade 56 is provided.

Also, in the image forming apparatus 101 according to the exemplary embodiment of the present invention, development is performed with the developer that contains the toner including the lubricant particles, as well as the inorganic particles, externally added to the toner particles. In this case, the efficiency of transfer of the toner image from the intermediate transfer body 50 to the recording paper P (an example of the recording medium) is maintained as compared with the case where the lubricant particles are not externally added.

The fluorocarbon resin particles (the fluorocarbon resin film formed by cracking or separation of the fluorocarbon resin particles) of the intermediate transfer body 50 are not supplied from outside and are thus gradually decreased in amount by repeating the image forming process.

Therefore, development is performed with the developer that contains the toner including the inorganic particles and the lubricant particles externally added to the toner particles. In this case, the lubricant particles are finely cracked at the tip (the accumulation at the tip) of the cleaning blade and thus, like the inorganic particles, the lubricant particles are considered to enter the recesses in the surface of the intermediate transfer body 50 and to be held by the fluorocarbon resin films that are formed around the recesses and formed upstream of the recesses in the rotational direction of the intermediate transfer body 50. Consequently, like the fluorocarbon resin, the lubricant components of the cracked lubricant particles may function to hold the inorganic particles adhering thereto.

Therefore, in the image forming apparatus 101 according to the exemplary embodiment of the present invention, development is performed with the developer that contains the toner including the lubricant particles as well as the inorganic particles externally added to the toner particles. In this case, the efficiency of transfer of the toner image from the intermediate transfer body 50 to the recording paper P (an example of the recording medium) is maintained as compared with the case where the lubricant particles are not externally added.

The configuration of the image forming apparatus 101 according to the exemplary embodiment of the present invention is not limited to the above-described configuration. For example, in order to make uniform polarity of the residual toner and facilitate cleaning with the cleaning brush or the like, a first erasing device may be provided around the circumference of the electrophotographic photoconductor 10 so as to be disposed downstream of the first transfer device 51 and upstream of the photoconductor cleaning device 70 in the rotational direction of the electrophotographic photoconductor 10. Further, in order to eliminate electricity of the surface of the electrophotographic photoconductor 10, a second erasing device may be provided downstream of the photoconductor cleaning device 70 and upstream of the charging device 20 in the rotational direction of the electrophotographic photoconductor 10.

In addition, the configuration of the image forming apparatus 101 according to the exemplary embodiment of the present invention is not limited to the above-described configuration, and a known configuration may be used. For example, a mode in which the toner image formed on the electrophotographic photoconductor 10 is directly transferred to the recording paper P, or a tandem-type image forming apparatus may be used.

EXAMPLES

The present invention is described in further detail below with reference to examples. However, the present invention is not limited to these examples. In description below, "parts" and "%" indicate "parts by mass" and "% by mass", respectively, unless otherwise specified.

[Developer 1]

(Preparation of Polyester Resin (A1) and Polyester Resin Particle Dispersion Solution (a1))

In a two-necked flask dried by heating, 15 molar parts of polyoxyethylene (2,0)-2,2-bis(4-hydroxyphenyl)propane, 85 molar parts of polyoxypropylene (2,2)-2,2-bis(4-hydroxyphenyl)propane, 10 molar parts of terephthalic acid, 67 molar parts of fumaric acid, 3 molar parts of n-dodecenyl succinate, 20 molar parts of trimellitic acid, and 0.05 molar parts (relative to the total number of moles of these acid components (terephthalic acid, n-dodecenyl succinate, trimellitic acid, and fumaric acid)) of dibutyl tin oxide are placed, and an inert atmosphere is maintained by introducing nitrogen gas in the flask, followed by heating. Then, cocondensation polymerization reaction is performed at 150° C. to 230° C. for 12 hours to 20 hours. Then, the pressure is gradually decreased at 210° C. to 250° C. to synthesize polyester resin (A1). The resin has a weight-average molecular weight Mw of 65,000 and a glass transition temperature Tg of 65° C.

In an emulsifying tank of a high-temperature-high-pressure emulsifying device (Cavitron CD1010, slit: 0.4 mm), 3,000 parts by mass of the resultant polyester resin, 10,000 parts by mass of ion exchange water, and 90 parts by mass of sodium dodecylbenzenesulfonate as a surfactant are placed, and the resultant mixture is melted by heating to 130° C. Then, the mixture is dispersed at 110° C. for 30 minutes by 10,000 rotations at a flow rate of 3 L/m and passed through a cooling tank. An amorphous resin particle dispersion solution is recovered (high-temperature-high-pressure emulsifying device (Cavitron CD1010, slit: 0.4 mm)) to produce polyester resin particle dispersion solution (a1).

(Preparation of Polyester Resin (B1) and Polyester Resin Particle Dispersion Solution (B1))

In a three-necked flask dried by heating, 45 molar parts of 1,9-nonanediol, 55 molar parts of dodecanedicarboxylic acid, and 0.05 molar parts of dibutyl tin oxide as a catalyst are placed, and air in the flask is replaced with nitrogen gas by a pressure reduction operation to create an inert atmosphere. Then, the resultant mixture is mechanically stirred at 180° C. for 2 hours, and then gradually heated to 230° C. under reduced pressure and stirred for 5 hours. After a viscous state is obtained, the reaction is terminated by air cooling to synthesize polyester resin (B1). The resin has a weight-average molecular weight Mw of 25,000 and a melt temperature Tm of 73° C.

Then, a polyester resin particle dispersion solution (b1) is prepared using a high-temperature-high-pressure emulsion device (Cavitron CD1010, slit: 0.4 mm) under the same conditions as for preparing the polyester resin dispersion solution (a1).

(Preparation of Colorant Particle Dispersion Solution)

Cyan pigment (manufactured by Dainichiseika Color & Chemicals Mfg. Co., Ltd., Pigment Blue 15:3 (copper phthalocyanine)): 1000 parts by mass Anionic surfactant Neogen SC (Dai-ichi Kogyo Seiyaku Co., Ltd.), anionic surfactant (sodium lauryl sulfate manufactured by Wako Pure Chemical Industries, Ltd.): 150 parts by mass Ion exchange water: 4000 parts by mass These components are mixed, dissolved, and then dispersed using a high-pressure impact disperser Ultimaizer (HJP30006, manufactured by Sugino Machine Ltd.) for 1 hour to prepare a colorant particle dispersion solution containing colorant (cyan pigment) particles dispersed therein. The colorant (cyan pigment) particles in the colorant particle dispersion solution has a volume-average particle diameter of 0.15 μm and a concentration of 20%.

(Preparation of Release Agent Particle Dispersion Solution)

Wax (WEP-2 manufactured by NOF Corporation): 100 parts by mass

Anionic surfactant Neogen SC (Dai-ichi Kogyo Seiyaku Co., Ltd.): 2 parts by mass Ion exchange water: 300 parts by mass Fatty acid amide wax (Neutron D, Nippon Fine Chemical Co., Ltd.): 100 parts by mass Anionic surfactant (Nurex R, manufactured by NOF Corporation): 2 parts by mass Ion exchange water: 300 parts by mass These components are heated to 95° C. and dispersed using a homogenizer (Ultra-Turrax T50, manufactured by IKA Works, Inc.) and then dispersed using a pressure discharge-type Gorin homogenizer (Gorin Inc.) to prepare a release agent particle dispersion solution (1) containing release agent particles dispersed therein and having a volume-average particle diameter of 200 nm (release agent concentration: 20% by mass).

(Formation of Tone Particles 1)

Polyester resin particle dispersion solution (a1): 340 parts by mass

Polyester resin particle dispersion solution o(b1): 160 parts by mass

Colorant particle dispersion solution: 50 parts by mass

Releasing agent particle dispersion solution: 60 parts by mass

Aqueous surfactant solution: 10 parts by mass 0.3 M aqueous nitric acid solution: 50 parts by mass Ion exchange water: 500 parts by mass These components are placed in a round-shaped stainless flask, dispersed using a homogenizer (Ultra-Turrax T50, manufactured by IKA Works, Inc.), and then heated to 42° C. in a heating oil bath and maintained for 30 minutes. Further, the temperature of the heating oil bath is increased, and the mixture is maintained at 58° C. for 30 minutes. When the formation of aggregated particles is confirmed, 100 parts by mass of additional polyester resin particle dispersion solution (a1) is added, and the resultant mixture is further maintained for 30 minutes.

Then, nitrilotriacetic acid Na salt (Chelest 70 manufactured by Chubu Chelest Corporation) is added at a ratio of 3% of the total solution. Then, a 1N aqueous sodium hydroxide solution is slowly added until the pH reaches 7.2, and the mixture is heated to 85° C. under continuous stirring and then maintained for 3.0 hours. Then, the reaction product is filtered off, washed with ion exchange water, and dried with a vacuum dryer to produce toner particles 1.

As a result of measurement of the particle diameter with a Coulter multi-sizer, the volume-average particle diameter D50 is 4.5 μm, and the particle size distribution factor GSD is 1.22.

(Formation of Toner 1)

First, 3 parts by mass of silica particles ("Fumed Silica RX50" manufactured by Nippon Aerosil Co., Ltd., volume-average particle diameter 40 nm) is added to 100 parts by mass of toner particles 1 and then blended for 15 minutes using a 5-liter Henschel mixer at a peripheral speed of 30 m/s. Then, coarse particles are removed with a screen with an opening of 45 μm to produce toner 1.

(Formation of Developer 1)

First, 100 parts of ferrite particles (manufactured by Powdertech Co., Ltd., average particle diameter 50 μm) and 1.5 parts of methyl methacrylate resin (manufactured by Mitsubishi Rayon Co., Ltd., molecular weight 95,000, ratio of components of molecular weight of 10,000 or less: 5%), together with 500 parts of toluene, are placed in a pressure kneader, followed by stirring and mixing at room temperature for 15 minutes. Then, toluene is distilled off by heating to 70° C. under reduced-pressure mixing, and then the residue is cooled and classified with a sieve of 105 μm to produce a resin-coated ferrite carrier.

The resultant resin-coated ferrite carrier is mixed with the toner 1 to form a developer 1 (two-component electrostatic latent image developer) having a toner concentration of 7% by weight.

[Developer 2]

Toner particles 2 are formed by the same method as for forming the developer 1.

Next, 3 parts by mass of silica particles ("Fumed Silica RX50" manufactured by Nippon Aerosil Co., Ltd., volume-average particle diameter 40 nm) and 0.5 part by mass of zinc stearate particles (volume-average particle diameter 5 μm) are added to 100 parts by mass of toner particles 1 and then blended for 15 minutes at a peripheral speed of 30 m/s using a 5-liter Henschel mixer. Then, coarse particles are removed with a screen having an opening of 45 μm to produce toner 2.

Then, a developer 2 is formed by the same method as for the developer 1 using the toner 2.

[Intermediate Transfer Belt 1]

(Preparation of Coating Solution for Forming Base Layer)

First, carbon black (SPECIAL Black 4, manufactured by Evonik Degussa Japan Co., Ltd.) at a solid content ratio of 8% by mass is added to a polyamic acid solution in N-methyl-2-pyrrolidone (NMP) (U Imide KX, manufactured by Unitika Ltd., solid content 20% by mass) containing biphenyltetracarboxylic dianhydride (BPDA) and p-phenylenediamine (PDA), followed by dispersion (200 N/mm$^2$, 5 passes) using a jet mill disperser (Geanus PY, manufactured by Geanus Co., Ltd.). The resultant carbon black-dispersed polyamic acid solution is passed through a stainless mesh of 20 μm to remove foreign substances and carbon black aggregates. Further, vacuum defoaming is performed under stirring for 15 minutes to form a final solution. This solution is used as a coating solution for forming the base layer.

(Preparation of Coating Solution for Forming Outermost Layer)

—Preparation of Carbon Black-Dispersed Polyamic Acid Solution—

First, carbon black (SPECIAL Black 4, manufactured by Evonik Degussa Japan Co., Ltd.) at a solid content ratio of 15% by mass is added to a polyamic acid solution in N-methyl-2-pyrrolidone (NMP) (U Imide KX, manufactured by Unitika Ltd., solid content 20% by mass) containing biphenyltetracarboxylic dianhydride (BPDA) and p-phenylenediamine (PDA), followed by dispersion (200 N/mm$^2$, 5 passes) using a jet mill disperser (Geanus PY, manufactured by Geanus Co., Ltd.). The resultant carbon black-dispersed polyamic acid solution is passed through a stainless mesh of 20 μm to remove foreign substances and carbon black aggregates. Further, vacuum defoaming is performed under stirring for 15 minutes to form a final solution.

—Preparation of Fluorocarbon Resin Particle-Dispersed Polyamic Acid Solution—

First, a polyamic acid solution in N-methyl-2-pyrrolidone (NMP) (U Imide KX, manufactured by Unitika Ltd., solid content 20% by mass) containing biphenyltetracarboxylic dianhydride (BPDA) and p-phenylenediamine (PDA) is prepared.

Next, PTFE particles having an initial particle diameter of 0.2 μm at a solid content ratio of 50% by mass are mixed with a fluorocarbon resin particle dispersant (S-386, manufactured by AGC Seimi Chemical Co., Ltd.) at a solid content ratio of 2% by mass, followed by dispersion (200 N/mm$^2$, 5 passes) using a jet mill disperser (Geanus PY, manufactured by Geanus Co., Ltd.).

The resultant fluorocarbon resin particle-dispersed polyamic acid solution is passed through a stainless mesh of 20 μm to remove foreign substances and PTFE aggregates. Further, vacuum defoaming is performed under stirring for 15 minutes to form a final solution.

—Preparation of Mixed Solution—

A mixed solution is prepared by mixing 500 parts by mass of the carbon black-dispersed polyamic acid solution and 500 parts by mass of the fluorocarbon resin particle-dispersed polyamic acid solution using a rotatory stirrer.

(Formation of Intermediate Transfer Belt)

A cylinder made of SUS304 having an outer diameter of 600 mm, a wall thickness of 8 mm, and a length of 900 mm is prepared. A disk having a thickness of 8 mm, an outer diameter allowing the disk to fit in the cylinder, and four vent holes of 150 mm in diameter is formed using the same SUS material, fit at each of the ends of the cylinder, and welded thereto, forming a core body. The peripheral surface of the core body is roughened to a Ra of 0.4 μm by blasting with alumina particles.

Next, a silicone release agent (trade name, Sepa-Coat manufactured by Shin-Etsu Chemical Co., Ltd.) is applied to the peripheral surface of the core body and then baked at 300° C. for 1 hour.

Next, the coating solution for forming the base layer is applied to the peripheral surface of the core body to form a coating film of a first film-forming resin solution.

Here, the coating solution for forming the base layer is applied by a helical application method.

As the application conditions, the coating solution for forming the base layer is ejected at 20 ml/min from a nozzle of a flow-down device including a Mohno-pump connected to a container that contained 15 L of the coating solution for forming the base layer, and the core body is rotated at 20 rpm. The ejected coating solution for forming the base layer is adhered to the core body, and then a blade is pressed to the surface of the core body and moved at a rate of 210 mm/min in the axial direction of the core body. The blade is formed by processing a stainless plate having a thickness of 0.2 mm into a width of 20 mm and a length of 50 mm. In addition, an application width ranged from a position of 10 mm from one of the ends of the core body to a position of 10 mm from the other end in the axial direction. After application, the core body is continuously rotated for 5 minutes to eliminate a helical line on the surface of the coating film.

As a result, the coating film of the coating solution for forming the base layer is formed, to a thickness of 160 μm. This thickness corresponds to a finishing thickness of 33 μm.

Then, the core body is placed in a drying furnace of 180° C. while being rotated at 10 rpm to dry the coating film of the coating solution for forming the base layer for 20 minutes. As a result, a film for the base layer is formed.

Next, the coating solution for forming the outermost layer is applied to the peripheral surface of the film for the base layer to form a coating film of the coating solution for forming the outermost layer.

Here, the coating solution for forming the outermost layer is applied by the same method as that for applying the coating solution for forming the base layer. However, as the application conditions, the amount of ejection from the nozzle is 40 ml/min, and the application width ranged from a position of 10 mm from one of the ends of the core body to a position of 10 mm from the other end in the axial direction. After application, the core body is continuously rotated for 5 minutes to eliminate a helical line on the surface of the film.

As a result, the coating film of the coating solution for forming the outermost layer is formed to a thickness of 300 μm. This thickness corresponds to a finishing thickness of 67 μm.

Then, the core body is placed in a drying furnace of 185° C. while being rotated at 10 rpm to dry the coating film of the coating solution for forming the outermost layer for 30 minutes. As a result, a film for the outermost layer is formed.

Next, the core body is separated from a rotating table and placed vertically in a heating furnace in which heating reaction is performed at 200° C. for 30 minutes and at 300° C. for 30 minutes to dry the residual solvents in the coating films for the base layer and the outermost layer and, at the same time, effect imidization reaction.

Then, a laminate including the base layer and the outermost layer is separated from the core body to produce an endless belt.

The resultant endless belt is cut at the center in the width direction, and unnecessary portions are cut from both ends to form two endless belts of 360 mm in width. The thickness is measured with a dial indicator 5 positions in the axial direction and at 10 positions in the peripheral direction, i.e., a total 50 positions. As a result, the total thickness is 100 μm.

The resultant endless belt is used as an intermediate transfer belt 1.

Example 1

"700 Digital Color. Press" manufactured by Fuji Xerox Co., Ltd. is prepared as an intermediate transfer-type image forming apparatus, a development device is filled with the developer 1, and the intermediate transfer belt 1 is mounted.

The intermediate transfer-type image forming apparatus is provided with a cleaning blade (pressure on an intermediate transfer body: 3 gf/mm) disposed in the doctor mode as a cleaning device for the intermediate transfer belt.

Example 2

The intermediate transfer-type image forming apparatus prepared in Example 1 is modified by disposing a cleaning blade in the wiper mode downstream of the cleaning blade disposed in the doctor mode in the rotational direction of the intermediate transfer belt.

Example 3

In the intermediate transfer-type image forming apparatus prepared in Example 1, the development device is filled with the developer 2 in place of the developer 1.

[Evaluation]

The efficiency of transfer of a toner image from the intermediate transfer belt to recording paper is evaluated using each of the intermediate transfer-type image forming apparatuses of the examples. The results are shown in Table 1.

The efficiency of transfer is evaluated by calculating the weight of a transfer residual image on the intermediate transfer belt downstream of the second transfer portion and the weight of a toner image before transfer. In this case, since the toner amount of the transfer residual image on the intermediate transfer belt is very small, the transfer residual image is transferred to a tape, and the density of the transferred image is measured. The toner amount is calculated from a relational expression between the density and toner amount, which is previously determined.

Specifically, the toner amount is calculated by the following expression:

Efficiency of transfer=(transfer residual image)/(transfer residual image+transferred image))

TABLE 1

| | Presence of fluorocarbon resin particles in outermost layer of intermediate transfer belt | External additive of toner | Cleaning blade for intermediate transfer belt | Efficiency of transfer (initial) | Efficiency of transfer (elapsed time) |
|---|---|---|---|---|---|
| Example 1 | Yes | Silica particles | Blade disposed in doctor mode | 95% | 90% |
| Example 2 | Yes | Silica particles | Blade disposed in doctor mode, blade disposed in wiper mode | 95% | 93% |
| Example 3 | Yes | Silica particles, lubricant particles | Blade disposed in doctor mode | 97% | 97% |

These results indicate that in the examples, a good efficiency of transfer is shown from the initial stage to the elapsed time.

It is also found that in Example 2 using the blade disposed in the wiper mode, a good efficiency of transfer is shown from the initial stage to the elapsed time as compared with Example 1.

It is further found that in Example 3 using the developer containing the toner containing the silica particles and the lubricant particles (zinc stearate particles) externally added to the toner particles, a good efficiency of transfer is shown from the initial stage to the elapsed time as compared with Example 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a charging unit that charges the surface of the image carrier;

an electrostatic latent image forming unit that forms an electrostatic latent image by exposure of the charged surface of the image carrier;

a development unit that houses an electrostatic latent image developer containing a toner containing toner particles and inorganic particles externally added thereto and that develops the electrostatic latent image formed on the image carrier with the developer to form a toner image;

an intermediate transfer body to which the toner image formed on the surface of the image carrier is transferred and the surface of which contains a resin material and fluorocarbon resin particles;

a first transfer unit that first transfers the toner image formed on the surface of the image carrier to the surface of the intermediate transfer body;

a second transfer unit that second transfers the toner image transferred to the surface of the intermediate transfer body to a recording medium; and a cleaning unit that cleans the surface of the intermediate transfer body after the toner image transferred to the surface of the intermediate transfer body is second transferred to the recording medium, the cleaning unit including a cleaning blade provided in contact with the surface of the intermediate transfer body, wherein the surface of the intermediate transfer body comprises a plurality of recess parts having a diameter, the diameter of each recess part is smaller than a diameter of a toner particle contained in the toner, wherein the recess parts each have a hemisphere shape.

2. The image forming apparatus according to claim 1, wherein the toner further contains lubricant particles externally added to the toner particles.

3. The image forming method according to claim 1, wherein the fluorocarbon resin particles are between 1% and 50% by mass of constituents of the surface.

4. The image forming method according to claim 1, wherein a fluorinated graft polymer is used as a dispersant such that the fluorocarbon resin particles are dispersed.

5. The image forming method according to claim 1, wherein the diameter of the recess part is smaller than 2 μm.

6. The image forming apparatus according to claim 1, wherein the cleaning blade includes:

a first cleaning blade provided in contact with the surface of the intermediate transfer body so that the tip is directed to a direction opposite to the rotational direction of the intermediate transfer body; and a second cleaning blade provided in contact with the surface of the intermediate transfer body so that the tip is directed to the rotational direction of the intermediate transfer body, the second cleaning blade being provided downstream of the first cleaning blade in the rotational direction of the intermediate transfer body.

7. The image forming apparatus according to claim 6, wherein the toner further contains lubricant particles externally added to the toner particles.

8. The image forming method according to claim 6, wherein the cleaning device causes separation of the fluorocarbon resulting in a fluorocarbon resin film having an area, wherein the first cleaning blade and the second cleaning blade each form the fluorocarbon resin film for each of the fluorocarbon resin particles, and the fluorocarbon resin particle formed by the second cleaning blade has a first area which is larger than a second area of the fluorocarbon resin particles formed by the first cleaning blade.

9. The image forming method according to claim 8, wherein a portion of the inorganic particles are held by the fluorocarbon resin films to decrease a contact area with the toner transferred to the surface of the intermediate transfer body.

10. An image forming method comprising:

charging the surface of an image carrier;

forming an electrostatic latent image by exposure of the charged surface of the image carrier;

developing the electrostatic latent image formed on the image carrier with an electrostatic latent image developer containing a toner to form a toner image, the toner containing toner particles and inorganic particles externally added thereto;

first transferring the toner image formed on the surface of the image carrier to a surface of an intermediate transfer body, the surface of the intermediate transfer body containing a resin material and fluorocarbon resin particles;

second transferring the toner image transferred to the surface of the intermediate transfer body to a recording medium; and cleaning the surface of the intermediate transfer body with a cleaning blade provided in contact with the surface of the intermediate transfer body after the toner image transferred to the surface of the intermediate transfer body is second transferred to the recording medium, wherein the surface of the intermediate transfer body comprises a plurality of recess parts having a diameter, the diameter of each recess part is smaller than a diameter of a toner particle contained in the toner, wherein the recess parts each have a hemisphere shape.

11. The image forming method according to claim 10, wherein the toner further contains lubricant particles externally added to the toner particles.

12. The image forming method according to claim 10, wherein the diameter of the recess part is smaller than 2 μm.

13. The image forming method according to claim 10, wherein the cleaning includes:

first cleaning the surface of the intermediate transfer body with a first cleaning blade provided in contact with the surface of the intermediate transfer body so that the tip is directed to a direction opposite to the rotational direction of the intermediate transfer body; and second cleaning the surface of the intermediate transfer body with a second cleaning blade provided in contact with the surface of the intermediate transfer body so that the tip is directed to the rotational direction of the intermediate transfer body, the second cleaning blade being provided downstream of the first cleaning blade in the rotational direction of the intermediate transfer body.

14. The image forming method according to claim 13, wherein the toner further contains lubricant particles externally added to the toner particles.

* * * * *